United States Patent [19]

Bahls

[11] 3,983,266

[45] Sept. 28, 1976

[54] METHOD FOR APPLYING METALLIC SILVER TO A SUBSTRATE

[75] Inventor: Harry Bahls, Wayne, Pa.

[73] Assignee: Peacock Laboratories, Inc., Philadelphia, Pa.

[22] Filed: Oct. 9, 1974

[21] Appl. No.: 513,417

[52] U.S. Cl. ..... 427/164; 427/165; 427/168; 427/424; 427/426; 106/1

[51] Int. Cl.[2] ..... C23C 3/02

[58] Field of Search ..... 106/1; 427/168, 169, 427/165, 164, 426, 304, 125, 425

[56] References Cited

UNITED STATES PATENTS

| | | | |
|---|---|---|---|
| 2,996,406 | 8/1961 | Weinrich | 427/168 |
| 3,772,078 | 11/1973 | Polichette et al. | 106/1 X |
| 3,776,740 | 12/1973 | Siverz et al. | 106/1 |

OTHER PUBLICATIONS

Ivanov et al., Chem. Abs. 43:2548c, 1949.

*Primary Examiner*—Ralph S. Kendall

[57] ABSTRACT

High efficiency deposition of silver on the surface of a substrate is obtained by providing a solution containing reducible dissolved silver in the presence of an alkali metal hydroxide and ammonia, all of which are applied to the substrate in the presence of an aqueous solution of a moderating reducer containing a polyhydric alcohol of the formula $CH_2OH(CHOH)_nCH_2OH$, where $n$ is an integer from 1 to 6. Preferably the polyhydric alcohol is sorbitol, and in a preferred embodiment a moderator is the form of a thio glycerol is present.

15 Claims, No Drawings

METHOD FOR APPLYING METALLIC SILVER TO A SUBSTRATE

BRIEF SUMMARY OF THE INVENTION

This invention relates to the application of metallic silver to the surface of a substrate, by reducing the silver from a solution in which the silver is present as a soluble silver salt. This invention relates particularly to the electroless deposition of silver and particularly to the deposition of silver with high efficiency upon a stationary object or a continuously moving surface of a substrate such as glass, plastic or ceramic, for example, in the coating of mirrors, decoration of objects and the like.

BACKGROUND OF THE INVENTION

It is already known in the art to provide methods and compositions for the electroless deposition of metallic silver on various substrates, such as glass plate in the manufacture of mirrors, and on other glass objects such as Christmas tree ornaments, etc.

The patent to Sivertz et al U.S. Pat. No. 3,776,740, granted Dec. 4, 1973, discloses one method for the electroless deposition of silver, utilizing a reducing agent in the form of an aldonic acid such as gluconic acid, for example. It is pointed out in the Sivertz et al patent that various mild reducing agents have been used, such as formaldehyde, glucose or invert sugar, but that the use of these materials have caused problems in the art, particularly since the silvering solutions are short-lived and the reducing agents tend to be unstable, often evolving hydrogen or decomposing to form sludge or interfering products. Using the method of the Sivertz et al patent, the components of the silvering solution are brought together just before contact with the substrate to be silvered. This may be achieved, for example, by pouring or pumping the component solutions such that they meet just before contact with the substrate. Alternatively, the component solutions may be air-atomized or hydraulically sprayed prior to or simultaneously with intermixing at the surface of the substrate. Othr reducing agents such as dextrose, fructose, arabinose nd invert sugar are referred to in the disclosure of the Sivertz et al patent.

OBJECTS OF THE INVENTION

It is an object of this invention to provide a method and solution for the electroless deposition of silver on a substrate, with higher efficiency than has heretofore been achieved by any of the procedures of the prior art. A further object of this invention is to provide a greater deposition efficiency in the reduction of silver from an ionic solution in which it is contained. Still another object is to provide a method of reducing silver from solution in a stationary manner or in a continuously running process, with a considerable saving of the silver applied to the substrate as a coating. Still another object of this invention is to provide a method for applying a superior coating of silver to a stationary or continuously running substrate, without utilizing any additional silver solution. Still another object of this invention is to provide a continuous method for the electroless deposition of silver upon a continuously running substance, wherein the silver is continuously reduced to the metallic state in a reaction, the rate of which is controlled by the presence of particularly effective reducing and modifying agents.

Other objects and advantages of this invention, including the economy of the same, and the ease with which it may be applied to existing silver coating equipment and apparatus, will further become apparent hereinafter.

DETAILED DESCRIPTION OF THIS INVENTION

It has been discovered that striking improvement in reduction efficiency can be obtained by the provision of a reducer solution in the form of an aqueous solution of a polyhydric alcohol of the formula $CH_2OH(CHOH)_nCH_2OH$, where $n$ is an integer from 1 to 6. The sharp improvement of efficiency is reflected in a considerable saving of valuable silver in the usual commercial processing plant, wherein the unreacted (unreduced) silver which remains in solution overflows into a trough or other collecting chamber, which may then be reclaimed. The process of reclamation is complicated by the presence of sludges and other undesirable side reaction products, and is complicated to such an extent that in many silvering estabishments the waste overflow solution and sludge is kept in a holding tank for a very substantial number of months before reprocessing is attempted. This results in the storage of waste materials containing silver of very substantial value, which is of no use whatsoever during the entire period of storage.

The polyhydric alcohols in accordance with this invention are also known as alditols, and are acyclic, polyhydric alcohols that are normally derived from aldoses or ketoses by the known reduction of the corresponding carbonyl group. For example, glucose may be reduced in the presence of a nickel catalyst to form dextro-glucitol, which is a hexitol and is a member of the alditol series.

Alditols may be divided on the basis of the number of carbon atoms found in the normal chain. Hence, alditols in accordance with this invention include tetritols, pentitols, hexitols, heptitols, octitols, etc.

Although the polyhydric alcohols having from 3 to 10 carbon atoms exist in a wide variety of forms, some of the most available forms include erythritol, threitol, arabinitol, ribitol, xylitol, allitol, galactitol, glucitol, iditol, manitol, altritol, volemitol, glycero-altro heptitol, erythrogalacto octitol and dextro and laevo isomers thereof. In accordance with this invention, it is highly preferred to use dextro-glucitol, or sorbitol, which is normally available as a crystalline material or as a 70% solution in water. Further, dextro-mannitol is a preferred reducer as well as all hexitols including all possible stereoisomers. It is also possible to use the laevo isomers, and the dextro-laevo mixtures. For example, laevo-glucitol and laevo-mannitol are highly desirable reducers in accordance with this invention.

In view of the fact that certain of the alditols have a tendency to undergo chemical change upon storage, it is highly desirable to incorporate into the aqueous solution a minor amount of a preservative such as formaldehyde or the like. The function of the formaldehyde in this connection should not be confused with the disclosures of the prior art which indicate that formaldehyde may be used as a mild reducing agent in the electroless deposition of silver, as referred to in the aforementioned Sivertz et al U.S. Pat. No. 3,776,740, inasmuch as the quantity of formaldehyde is limited to about 5 to 15 ml per pound of polyhydric acohol, which latter constitutes the reducing agent in accordance with this invention, quantities being expressed as a 40% solution.

Further, in accordance with this invention, it is highly esirable to combine a moderator compound with the olyhydric alcohol and to apply the moderator to the urface of the substrate concurrently with the applicaion of the silver solution. Preferably, the moderator ompound is a thio compound or mercaptan of the ormula $CH_2OH(CHOH)_mCH_2SH$, where $m$ is an integer from 0 to 1. The highly preferred thio compound is -thio glycerol, or mercapto glycerol.

A wide variety of manipulative procedures are available in the actual practice of this invention. When the ilvering process is to be applied to a conveyorized ystem in which a substrate, such as a sheet or plate of lass for example, is continuously advanced in a horiontal plane, on a conveyor, it is highly desirable to rovide one or more sets of spray guns which are nounted for swinging movement back and forth above he surface of the glass, each set of spray guns being rranged to apply the respective solutions substantially oncurrently to substantially the same location, on the urface of the glass. The sprays of different solutions, ndependently delivered to the situs and independently rojected are then mixed with one another and concurently distribute themselves upon the surface of the glass, whereupon the silver reduction reaction takes place at a delicately controlled rate, in a manner to deposit the silver uniformly and tenaciously on the urface of the glass, depositing a major percentage of he original silver contained in the silver solution upon he glass, before the solution runs off into the collecting rough.

Desirably, two or more solutions are separately provided and these are delivered to spray guns which are mounted for traversing across the upwardly exposed surface of the glass which is traveling continuously on the conveyor. Each gun separately provides a single solution to the surface of the glass. Separate solution tanks that contain either concentrated or dilute solutions are preferably provided, each connected to its associated gun. In this manner, the individual solutions are concurrently applied to the glass as heretofore described. Desirably, the spray guns are provided in a succession or series of banks, in order to apply successive layers of silver, each upon its predecessor.

This invention is applicable universally to systems using hydraulic pumps for the delivery and projection of the solutions, and to systems utilizing air pressure for actuating the sprays.

It is highly desirable in accordance with this invention to provide at least three solutions which are concurrently applied to the substrate. These are conveniently referred to as solutions A, B and C. However, there are some circumstances when it is preferable to mix two of these solutions together.

With respect to solution A, this solution contains a silver salt, desirably silver nitrate, mixed with ammonia to provide a soluble silver ammine compound, having a formula of the general type $Ag_2O.NH_3$ or $[Ag(NH_3)_2]NO_3$, etc. a colorless solution. The quantities of silver nitrate per gallon may vary within the general range of about 30 to 36 ounces avoirdupois per gallon, and the amount of ammonia may also vary, for example between 45 to 75 fluid ounces of ammonium hydroxide (28° Baume) per gallon.

With respect to solution B, which might be referred to as an activator solution, this solution desirably contains an alkali and ammonia. For example, suitable alkalis include sodium hydroxide and potassium hydroxide, and it is preferred to use a concentrtion of about 1 to 1¾ pounds of sodium hydroxide per gallon of activator solution, together with about 0 to 20 fluid ounces of 28° ammonium hydroxide per gallon of solution. Desirable specific compositions include 1.70 pounds per gallon of sodium hydroxide and 13 fluid ounces of ammonium hydroxide (28° Baume).

Regarding solution C, which might be referred to as a reducer solution, this solution contains about ½ to 2 pounds per gallon of sorbitol (100% sorbitol) when sorbitol is the polyhydric alcohol selected for use in accordance with the invention, and about 15 to 25 ml of formaldehyde (40% solution) per gallon of concentrated solution. Ideal compositions include about 2.5 pounds per gallon of 70% sorbitol and 19 ml of formaldehyde (40% solution), per gallon.

In commerical use, solutions A, B and C may be made up separately and held in separate solution tanks A, B and C. These solutions may be separately conducted to separate guns and separately sprayed upon the surface of the substrate in which the mixing occurs just prior to reaching the substrate. On the other hand, it is sometimes considered desirable to mix solutions A and B with one another, and to conduct them jointly through one gun while conducting solution C through a separate gun for separate spraying upon the substrate. Other modifications and forms of procedures and apparatus may be substituted, provided however that the reducer solution C should highly preferably be kept separate from the other solutions until subtantially the time of actual contact with the substrate itself.

It has been found in accordance with this invention that the presence of ammonium hydroxide in the sodium hydroxide solution B increases the brilliance of silver deposition when solutions A and B are combined with a polyhydric alcohol in accordance with this invention.

It is highly preferable to maintain the pH of the reacting solutions at a value of about 12½ or higher, preferably 12.6 or higher, in order to obtain optimum efficiency in accordance with the method of this invention.

Solutions in accordance with this invention are highly effective at a wide variety of temperatures. This is an important factor, because it is desirable to use purified or deionized water that is available at the particular silvering plant in question, regardless of the season of the year without the extreme heating of the water that is the practice at many plants. Thus, there is considerable fluctuation in many geographic locations with respect to water temperature, and it is highly desirable in accordance with this invention to provide a process which operates with optimum efficiency throughout this wide range of temperature. The polyhydric alcohols utilized in accordance with this invention are stable enough to maintain high rates of silver deposition throughout the range from as low as 20°C up to as high as 50°C and above.

It is important in accordance with this invention to store the polyhydric alcohol, particularly sorbitol, in the absence of highly alkaline media such as sodium hydroxide solutions, except for relatively short periods of time. For example, in approximately a half-hour, the efficiency of sorbitol to reduce silver diammine ions to pure metallic silver is greatly decreased, and the film produced tends to become spotty upon the substrate. Accordingly, although it is not necessary to feed all of the solutions A, B and C individually for application to the substrate, it is desirable to avoid mixing solution C with either solution A or solution B. It is entirely permissible, however, to premix the solutions A and B, as has heretofore been discussed.

EXAMPLE I

The rate of silver deposition on a confined glass surface was measured using various reducers from a reacting solution that also contained silver diammine ions and sodium hydroxide.

The following reducers were tested: sodium potassium tartrate (Rochelle Salt), fructose, dextrose, sodium glucoheptonate and glucitol (sorbitol).

All variables were maintained at the following values:

| | |
|---|---|
| Silver diammine ions | .05 moles per liter |
| Sodium hydroxide concentration | .15 moles per liter |
| Reducer concentrations | .05 moles per liter |
| Reaction time | 2 minutes |
| Reaction temperature | 30° C |

Deposition of silver was 155 mg/sq ft for d-glucitol while sodium gluchoheptonate gave only 148. Comparable figures for other reducers were: dextrose 125, fructose 107 and NaK tartrate 103. D-glucitol exemplifies a markedly increased rate of silver deposition in comparison to conventional reducers.

EXAMPLE II

The rate of silver deposition on a confined glass surface was measured using various reducers at different concentrations. The following constant parameters were used:

| | |
|---|---|
| Silver diammine ions | .05 moles per liter |
| Sodium hydroxide | .15 moles per liter |
| Reaction time | 2 minutes |
| Reaction temperature | 25° C |

The reducers tested were fructose, sodium glucoheptonate and d-glucitol (sorbitol). Only the identity of the reducer itself and the concentration of that reducer were varied.

The results appear in the following table as mg/sq ft of silver deposited versus reducer concentration.

Table I

| | Deposition of AG — MG/FT² | | |
|---|---|---|---|
| Concentration | Fructose | Sodium Glucoheptonate | d-Glucitol |
| 0.25 | 140 | 145 | 150 |
| 0.50 | 120 | 175 | 185 |
| 0.75 | 90 | 180 | 190 |
| 1.00 | 67 | 180 | 190 |
| 1.25 | — | 180 | 190 |
| 1.50 | — | 180 | 190 |

D-glucitol thus provides greatly improved rates of silver deposition versus conventional reducers. The rate of deposition rose quickly and was maintained at a high rate for various ranges of reducer concentration.

EXAMPLE III

A plant run was conducted, utilizing an air-atomized system, and using guns mounted on transverse arms moving back and forth over a moving glass plate which was running (downstream) on a continuous conveyor. Several sets of spray guns were utilized, in series, spaced about one foot apart, each set spraying just downstream of its predecessor. In this run, solutions were used as follows:

Solution A: $AgNO_3$:33 oz avoir/gal + 70 fl oz $NH_4OH$ 28° Baume

Solution B: (activator) 1.70 lbs./gal NaOH; 13 fl oz $NH_4OH$ 28° Baume

Solution C: (reducer) 2.5 lbs./gal sorbitol, 19 ml (40% solution) preservative

The rate of application of these solutions was varied by varying the pump setting to control and regulate the speed of the pump providing the concentrated solutions, utilizing a constant rate of coating in terms of square feet of glass coated per minute. After establishing steady state conditions, silver deposition of 70 mg/sq ft was obtained using solutions A, B and C separately, having the compositions defined above, and this produced a deposition rate of 44 sq ft per min utilizing a pump setting providing 33 ml/min of concentrated solution.

In contrast, a solution was prepared containing the same amount of sodium glucoheptonate instead of d-glucitol. A pump setting of 44 ml/min of concentrated solution was required to produce a coating rate of 44 sq ft per min, with silver deposition of 70 ml/sq ft.

The resulting silver film was very bright and evenly applied. The pump settings used for the sorbitol solution were lower than the pump settings used with sodium glucoheptonate. The silver film was heavier than that produced by the glucoheptonate reducers, and much brighter.

Salt spray tests were conducted based on a modified ASTM test method No. B 117-72 on mirror samples taken from these runs. The film was protected in the usual manner with standard mirror backing paint and the results showed excellent adherence of silver to glass. There was no leafing of the silver from the glass.

The samples of these mirrors were placed in salt spray. After 637 hours of continuous salt spray exposure (in accordance with a modified version of ASTM method B 117-72 for mirrors), the silver still adhered well with no signs of peeling from the glass.

EXAMPLE IV

The following tests were conducted to determine the amount of silver deposition on a glass beaker, utilizing different concentrations of sorbitol but using a concentration of silver nitrate solution of 33 oz avoir/gal (0.244 g/ml) with a 30-1 dilution ratio of water to concentrate silver, and using sodium hydroxide concentrations of 1 lb/gal and 1.5 lb/gal. The following results were obtained using 10 milliliters each of the diluted solutions A, B and C:

Table II

| Concentration | Test No. | [Sorbitol] (molar concentration) | Amount of Ag Deposition on glass beaker (mg/sq ft) | Comments on Film Quality |
|---|---|---|---|---|
| $NaOH = 3 \times 10^{-2}$ molar | 1 | .25 M | 0.25 | Good, light deposit |
| | 2 | .50 M | 0.25 | Good, light deposit |
| | 3 | .75 M | 0.30 | Good, light deposit |

Table II-continued

| Concentration | Test No. | [Sorbitol] (molar concentration) | Amount of Ag Deposition on glass beaker (mg/sq ft) | Comments on Film Quality |
|---|---|---|---|---|
| | 4 | 1.00 M | 0.25 | Good, light deposit |
| | 5 | 1.25 M | 0.35 | $Ag^0$ brighter than above |
| | 6 | 1.50 M | 0.30 | $Ag^0$ film better |
| | 7 | 2.00 M | 0.50 | Good film |
| NaOH = $5 \times 10^{-2}$ molar | 8 | .25 | 0.30 | $Ag^0$ film: good, light deposit |
| | 9 | .50 | 0.30 | $Ag^0$ film: good, light deposit |
| | 10 | .75 | 0.35 | $Ag^0$ film: good, light deposit |
| | 11 | 1.00 | 0.30 | $Ag^0$ film: good, light deposit |
| | 12 | 1.25 | 0.40 | $Ag^0$ film: good, light deposit |
| | 13 | 1.50 | 0.35 | $Ag^0$ film: good, light deposit |
| | 14 | 2.00 | 0.50 | $Ag^0$ film: good, light deposit |
| $NH_4OH$ = $10^{-2}$ molar | 15 | .25 | 0.25 | $Ag^0$ film clean and bright and noticeably different from above samples |
| | 16 | .50 | 0.35 | |
| NaOH = $5 \times 10^{-2}$ molar | 17 | .75 | 0.35 | |
| | 18 | 1.00 | 0.40 | |
| | 19 | 1.25 | 0.40 | $Ag^0$ film appeared good |
| | 20 | 1.50 | 0.35 | |
| | 21 | 2.00 | 0.35 | |
| | 22 | 3.00 | 0.35 | Excellent film appearance |

EXAMPLE V

Further tests were conducted utilizing different concentrations of sodium hydroxide, and also utilizing 1-thio glycerol in a concentration of $10^{-3}$ molar, with the results obtained as stated in Table III which follows.

The sorbitol which was used in the tests reported in Table III had the following characteristics:

| | |
|---|---|
| Viscosity | 100 cps (25° C) |
| Flash point | above 300° F |
| Fire point | above 300° F |
| Boiling point | 105° C (760 mm) |
| Refraction index | 1.458 (25° C) |
| Hygroscopicity | Medium, lower than glycerin or glycols |

Table III

| Concentration | Test Run No. | Sorbitol concentration (M) | $Ag^0$ Deposition (mg/sq ft) | Comments |
|---|---|---|---|---|
| [NaOH] = $8 \times 10^{-2}$ molar concentrate (6 ml diluted S-B to 90 ml $H_2O$ | 23 | .25 | 0.30 | O. K. |
| | 24 | .50 | 0.40 | Silver film brighter |
| | 25 | .75 | 0.30 | Bright silver film |
| | 26 | 1.00 | 0.35 | Bright silver film |
| | 27 | 1.25 | 0.35 | Brightest, clearest film of all |
| | 28 | 1.50 | 0.35 | Good film |
| $10^{-2}$ molar $NH_4OH$ added to NaOH | 29 | 2.00 | 0.35 | O. K. |
| | 30 | 3.00 | 0.45 | O. K. |
| [NaOH] = $6 \times 10^{-2}$ molar | 31 | .25 | 0.40 | Very bright, $Ag^0$ film thick |
| | 32 | .50 | 0.50 | Film much heavier |
| | 33 | .75 | 0.45 | Very bright; best overall |
| $10^{-2}$ molar $NH_4OH$ added to NaOH solution | 34 | 1.00 | 0.45 | Good film |
| | 35 | 1.25 | 0.50 | Same results |
| | 36 | 1.50 | 0.45 | Results similar to 1.25 M of sorbitol for remaining reactions |
| | 37 | 2.00 | 0.55 | |
| | 38 | 3.00 | 0.65 | |
| [NaOH] = $6 \times 10^{-2}$ molar | 39 | 0.50 | 0.20 | Doubling the $NH_4OH$ concentration decreased the amount of $Ag^0$ deposited nearly to half |
| | 40 | 0.75 | 0.30 | |
| | 41 | 1.25 | Not titrated but very thin | |
| $2 \times 10^{-2}$ $NH_4OH$ added to NaOH | 42 | 2.00 | Not titrated but very thin | |

The addition of ammonium hydroxide to sodium hydroxide definitely improved the rate of reaction. It also produced a silver film that was very much brighter and cleaner in appearance.

The sodium hydroxide concentration is also of importance. An increase of NaOH concentration increased the deposition of silver — to a point.

The optimum silver deposition occurred at an NaOH concentration of 1.75 lbs/gal (in the concentrated form of solution) with 0.3 ml of $NH_4OH$ added to 90 ml of the diluted sample. This corresponds to 7.2 fluid ounces $NH_4OH$ per gallon of NaOH solution.

Very favorable concentrations were found in Run No. 33, from the viewpoint of overall appearance, speed and deposition efficiency, while also considering the amount of sorbitol used.

EXAMPLE VI

This test was directed to stability of sorbitol at 30-1 dilution of NaOH and sorbitol with $H_2O$, and feeding conjunctively. Sorbitol (0.75 M) was mixed in 30-1 dilution and reacted with silver. Then the sorbitol was allowed to stand for a minimum of 6 hours to determine the effectiveness of reducing capabilities for $Ag^0$.

The stability test of diluted reducer included the following steps:

1. Sorbitol concentrate (1.25 M) was diluted one part sorbitol with 30 parts water. The reducer was mixed with silver and NaOH and the reaction took place in a glass beaker (1.5 mm). The film was dissolved in nitric acid and titrated with KCNS.

2. Six hours later the same reaction was conducted using the diluted samples, and the Ag film was titrated against KCNS to obtain a direct comparison.

| | | mg. Ag deposited |
|---|---|---|
| Results: | Sorbitol (fresh) | 0.40 |
| | Sorbitol (6 hours) | 0.40 |

This test demonstrates that sorbitol does not lose efficiency after 6 hours. It has been found that such solutions can be used after storage overnight, without reduction of efficiency.

EXAMPLE VII

Solutions of sorbitol were made 70% at 1.25 M and potassium sorbate pellets and powder samples were added. Potassium sorbate was added at concentrations of 0.1% and 0.01%. The potassium sorbate was used as a mold inhibitor, used in place of formaldehyde.

The following tests were run:

| Sample No. | Sorbitol concentration | K Sorbate concentration |
|---|---|---|
| KS powder | 1.25 M | 0.1% (by wt.) powder |
| KS powder | 1.25 M | 0.01% (by wt.) powder |
| KS pellets | 1.25 M | 0.10% (by wt.) pellets |
| KS pellets | 1.25 M | 0.01% (by wt.) pellets |

There was no indication of interference with the reaction and the presence of sorbate did not increase or promote sludging or sludge time.

EXAMPLE VIII

Mannitol solution preparation (MTL = mannitol)

| Sample No. | Molar Concentration | Grams/100 ml | Pellets (K Sorbate concentration) |
|---|---|---|---|
| MTL 25 | 0.25 M | 4.55 | –0.10% |
| MTL 50 | 0.50 M | 9.11 | –0.10% |
| MTL 75 | 0.75 M | 13.67 | –0.10% |
| MTL 1.00 | 1.00 M | 18.22 | –0.10% |
| MTL 1.25 | 1.25 M | 22.78 | –0.10% |
| MTL 1.50 | 1.50 M | 27.33 | –0.10% |

Procedure:

1. Tests were run at 1.5 min in 100 ml beakers. At that time excess solutions were discarded and beakers rinsed.

2. Concentrations of reactants:

| | |
|---|---|
| $Ag(NH_3)_2$+ | 33 av. oz. $AgNO_3$/gal and 70 fl. ozs. $NH_4OH$/gal |
| NaOH | 1.70 lb. of NaOH/gal. |
| $NH_4OH$ | 13 fl. oz. of 28° Be per gal. |
| Mannitol | variable (as above) |
| Temperature | 30° C |

All solutions were diluted 30-1 with deionized water. 1-thio glycerol was added in the concentration of 0.004% by weight.

Procedure:

The number of mg. of precipitated Ag was calculated using the Volhard titration method for quantitative analysis of $Ag^0$ using standardized KSCN.

The results were as follows:

| Run No. | Mannitol concentration | Gms. $Ag^0$ | Comments |
|---|---|---|---|
| 43 | 0.25 M | .0024 | Immediate deposit, no sludge, clear film |
| 44 | 0.50 M | .0034 | Clean film, good deposit |
| 45 | 0.75 M | .0040 | Heavier $Ag^0$ deposit |
| 46 | 1.00 M | .0037 | Clean film, good $Ag^0$ deposit |
| 47 | 0.25 M | .0074 | Allowed sludging. Reaction was allowed to proceed for 5½ min to completion |
| 48 | 0.50 M | .0095 | Allowed sludging. Reaction was allowed to proceed for 6 min to completion. |

EXAMPLE IX

Reaction of sorbitol at reduced temperatures:

1. Solutions were cooled to 20° C (68° F) and reacted in 150 ml beakers. Solutions were also run using potassium sorbate pellets.

2. Reaction time: 1.5 min.

3. Standard [Ag]; NaOH = 1.70 lbs/gal. + 13 fl. ozs. $NH_4OH$ were used as stock solutions and diluted 30:1 with distilled $H_2O$.

Temperature variance v. rate of reaction

Results:

Reaction occurred quickly at the reduced temperatures and the samples were set aside for titration analysis. The films of silver which had been produced at reduced temperatures were similar in appearance to those run at room temperature.

| Sample Description | No. grams/beaker |
|---|---|
| 1) Sorbitol: 1.25 M 20° C solutions | .0024 |
| 2) Sorbitol: 1.25 M 27° C KSP 0.1% | .0025 |
| 3) Sorbitol: 1.25 M 27° C KSP 0.01% | .0025 |

A nearly 10° C drop in temperature had a negligible effect on the rate of deposition of silver versus the rate of reaction at 27° C for samples 2 and 3.

Among the polyhydric alcohols and particularly the alditols, the following classes exist:

1) Tetritols

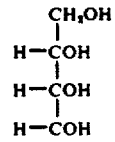

Erythritol

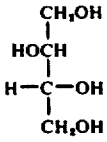

D-Threitol

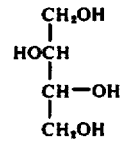

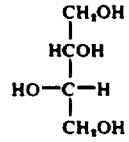

D, L Threitol

2) Pentitols

-continued

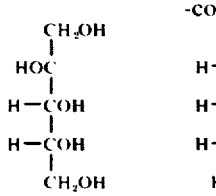

D-Arabintol (D-Lyxitol)

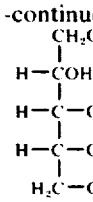

Ribitol

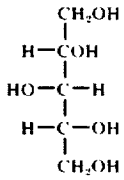

Xylitol

D-glucose has been converted into penitols in yield of 35 – 40%. It is obtained through synthesis by reduction of D-arabinose or D-lyxose by sodium amalgam or sodium borohydride. L-arabinitol has been prepared by reduction of L-arabinose and also the Cannizzaro reaction with L-arabinose in the presence of nickel.

In view of the compatibility of the polyhydric alcohols with each other, they may be used individually or in any desired combination with each other.

3) Hexitols (a) Allitol (Meso)

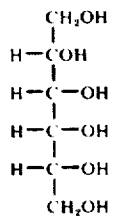

(b) Galactitol (Meso)

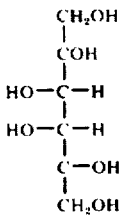

(c) D-Glucitol

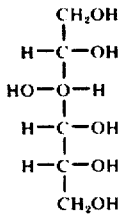

(d) D-Iditol

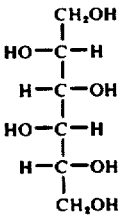

(e) D-Mannitol

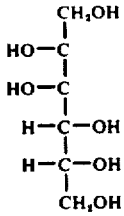

(f) D-Altritol

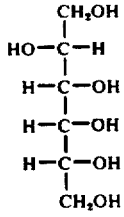

4) Heptitols

-continued

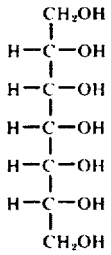

Volemitol

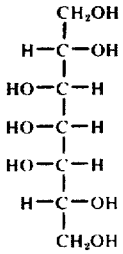

Meso-Glycero-altro

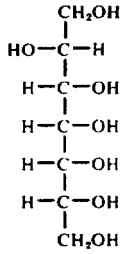

D-Glycero-Daltro

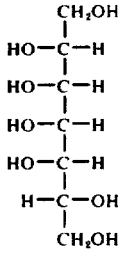

D-Glycero-L Allo

5) Octitols i.e.: D-erythro-D-Galacto-octitol: the only 8 carbon chained alditol that occurs naturally.

EXAMPLE X

Tests were conducted on the effect of temperature on rate of silver deposition reaction, and to compare directly the reducing capacities of other reducers, namely, fructose, dextose, gluconic acid and sodium heptagluconate versus D-glucitol and D-mannitol.

Concentrations of chemicals:

| | | |
|---|---|---|
| $(Ag)(NO_3)^+$ | = | $3 \times 10^{-2}$ moles/liter |
| NaOH | = | $15 \times 10^{-2}$ moles/liter |
| $NH_4OH$ | = | $1 \times 10^{-2}$ moles/liter |
| Reducer | = | $3 \times 10^{-2}$ moles/liter |
| Reaction time | = | 1.5 min. (90 sec.) |

| Run No. | Concentration of reducer | Gms. $Ag^0$ | Comments |
|---|---|---|---|
| 49 | 0.75 M (Mannitol) | .0057 | Deposition at 50° C (122° F). A good, heavy film was produced |
| 50 | 0.75 M (Mannitol) | .0057 | T° = 45° C (104° F) |
| 51 | 0.25 M (Mannitol) | .0028 | 30° C |
| 52 | 0.50 M (Mannitol) | .0034 | 30° C |
| 53 | 0.75 M (Mannitol) | .0038 | 30° C |
| 54 | 1.00 M (Mannitol) | .0034 | 30° C |
| 55 | 0.50 M (Mannitol) | .0033 | 25° C |
| 56 | 0.75 M (Mannitol) | .0036 | 25° C |

EXAMPLE XI

An object of this example is to demonstrate rates of reactions of other reducer solutions for a direct comparison with sorbitol. The compounds tested in this case were the following: (1) potassium sodium tartrate, (2) fructose, (3) gluconic acid, (50% Pfizer) (4) sodium heptagluconate, (5) sorbitol, (6) mannitol, (7) dextrose.

All variables in this test were maintained constant except for the nature of the reducing material. The silver solution employed was a silver diammine solution and the constants were as follows:

| | |
|---|---|
| $AgNO_3$ | $4 \times 10^{-2}$ moles/l |
| NaOH | $15.0 \times 10^{-2}$ moles/l + 0.3 ml $NH_4OH$ (28%) |
| Reducer | $4 \times 10^{-2}$ moles/l + 1-thio glycerol (.004% by wt.) |
| Reaction time | 120 sec. |
| Reaction temperature | 30° C |

| Run No. | Reducer | Grams $Ag^0$ deposited |
|---|---|---|
| 57 | Gluconic acid-50% | .0031 |
| 58 | Sodium glucoheptonate | .0037 |
| 59 | Fructose | .0032 |
| 60 | Potassium sodium tartrate | .0032 |
| 61 | Dextrose | .0030 |
| 62 | Sorbitol-70% | .0043 |

The gluconic acid 50% sample of Run No. 57 had changed color because of limited shelf life from a straw colored substance to a brown color. The effectiveness of this material as a reducer was most probably impeded due to this degradation. However, the sodium glucoheptonate sample which was derived from a salt powder showed no signs of degradation. The results of these tests show conclusively the greater reducer capabilities of sorbitol.

Each solution of reducer was modified or "buffered" to retard sludge formation with 1-thio glycerol. The dextrose solution was the only reducer to sludge in the 120 sec. reaction time.

Fructose produced a highly reflective coat but its film weight was about one-third less than that obtained with sorbitol.

Potassium sodium tartrate produced a yellowish cast on silver film and the film also had pinholes. This reducer is totally unacceptable.

Dextrose produced a good film but the sludging in this solution was quite difficult to control to obtain optimum reducing capabilities. Further, the weight of silver deposited was significantly lower than the corresponding average weight deposited by an equimolar solution of sorbitol.

Sorbitol, a hexahydric alcohol (alditol), accordingly, has a much greater ability to reduce silver to a metallic state than gluconic acid and a salt of a monocarboxylic acid such as sodium glucoheptonate.

EXAMPLE XII

A run was conducted in a continuously running conveyor line for the production of mirrors, utilizing a three part sludgeless process using solutions A, B and C as follows:

Concentrations:

A. Silver diammine 33 av. ozs./gal + 60 fl. ozs. $NH_4OH$/gal.

B. Sodium hydroxide 1.5 lbs./gal + 1 fl. ozs. $NH_4OH$/gal.

C. Sorbitol 2.5 lbs./gal (of 70% sorbitol solution) 19 ml formaldehyde/gal (40% solution $CH_2O$) 0.1 ml. thiovanol The procedure was as follows:

1. Mix solutions in the ratio of 29 gals. of water to one gal. each of silver, caustic and reducer.

2. Solutions were sprayed at 125° – 130° F. All solutions passed through a heated coil which was immersed in a heated bath at a temperature of 125° – 130° F. Rinse water was also heated at same temperature and sprayed on the glass prior to silvering in order to increase the glass temperature.

3. 3. section: 3 min. reaction time before final rinse of silvering solution with water.

4. Silvering was accomplished by an airless spray system. The console was provided with metered flow which was set at settings 9 and 11. (Flow rates for these settings are listed below.)

5. The conveyor was 68 inches wide × 72 inches/min. linear speed. A day's run was conducted, utilizing approximately 1500 sq. ft./hr of glass surface, for 10 hours. This silvers 34 sq. ft./min = 2040 sq. ft./hr. = 20,400 sq. ft. 1 day.

6. Spray tips:

| | | No. 9 setting | No. 11 setting |
|---|---|---|---|
| 1st spray set: | .050" orifice | about 300 ml/min | about 325 ml/min |
| 2nd, 3rd, 4th spray sets: | .010" orifice | about 175 ml/min (for each gun) | about 200 ml/min (for each gun) |

Various settings of flowmeter were used, including setting "9" which is usually used for window glass, and setting "11" which is usually used for providing a thicker silver coating on plate glass.

Run a

A dilution of 40:1 (5 gals. $H_2O$ to 1 pt. concentrate ABC) was used. The other reaction conditions were:

| | | |
|---|---|---|
| Temperature | : | 68° F (20° C) |
| Reaction time | : | 3 mins. |
| Meter setting | : | No. 1 = 9; No. 2 = 11 |
| Silver deposit | : | 70 mg/sq.ft. No. 9 setting<br>71 mg/sq.ft. No. 11 setting |

It was observed that the silver deposited very evenly, cleanly (without sludge) and quickly.

Run b

Another run using the same equipment was conducted under the following conditions:

| | | |
|---|---|---|
| Dilution | : | 40:1 |
| Temperature | : | 120° F |
| Meter setting | : | No. 1 = 9; No. 2 = 11 |
| Silver deposit | | 71 mgs/sq.ft. No. 9 setting;<br>73 mgs/sq.ft. No. 11 setting |

Results and observation: the silver deposit increased with a 52° C increase of temperature. This shows that the reducer of this invention can be used either hot or cold. This increase of temperature, though drastic, did not produce a drastic increase of silver film weight at this dilution.

Run c

This is a comparative example, using dextrose solution as solution C. All operating conditions, including speed and reaction time, were the same as in Runs (a) and (b).

| | Flow setting | Temperature | Ag deposit (mg/sq.ft.) | Dilution Ratio (gal $H_2O$/gal concentration rate ABC) |
|---|---|---|---|---|
| Dextrose | 11 | 130° F | 90 | 29:1 |

-continued

| | Flow setting | Temperature | Ag deposit (mg/sq.ft.) | Dilution Ratio (gal $H_2O$/gal concentration rate ABC) |
|---|---|---|---|---|
| Sorbitol | 11 | 80° F | 95 | 33:1 |

Accordingly, even at a lower temperature and greater dilution, the sorbitol solution reduced a greater quantity of silver on the glass substrate.

Sorbitol (d-glucitol) does react quickly enough to provide a sufficient silver film that is acceptable to today's mirror manufacturers at room temperature (68° F or 20° C), and has an advantage in that the dilution ratio is 40 to 1 versus 28 to 1 of other solutions. This provides 12 additional gallons of ready-to-spray material and thus reduces the cost of solutions very significantly.

Accordingly, in this example, dextro-glucitol was shown to improve sharply the rate of silver deposition. In a conveyor run of 10 hours, the substitution of dextro-glucitol for dextrose results in a saving of approximately 1 gallon of silver concentrate per day, for a run of about 20,000 sq ft of glass. This is due to the much higher efficiency of the reducer solution, where efficiency is defined as the number of milligrams of silver deposited divided by the number of milligrams of silver sprayed, times 100.

EXAMPLE XIII

Further tests were conducted using the equipment described in Example XII but with respect to dilution ratio, as follows:

1. Dilution ratio: 40 parts water to 1 part concentrate. However, NaOH concentration was increased slightly to a NaOH concentrate of 1.75 lbs/gal instead of 1.50 lbs/gal. Also, 10 ml of $NH_4OH$ was added. No other constitutents were changed in concentration — only NaOH.

| | |
|---|---|
| Temperature: | 125° F |
| Reaction time: | 180 sec. |
| Meter setting: | No. 1 at 9, No. 2 at 11 |
| Silver deposit: | 72 mgs/sq ft No. 1<br>73 mgs/sq ft No. 2 |

It was observed that silver film increased slightly with an increase of NaOH concentration. Good silver deposition was observed and it occurred very quickly. The silver film is excellent in quality.

2. Dilution ratio: Same NaOH concentration as above (1), same silver concentration as throughout and 100 ml additional of 1.25 M sorbitol solution.

| | |
|---|---|
| Temperature: | 125° F |
| Reaction time: | 180 sec. |
| Meter setting: | No. 1 at 9, No. 2 at 11 |
| Silver deposit: | 73 mgs/sq ft No. 1<br>74 mgs/sq ft No. 2 |

It was observed that there was an increase of reducer concentration along with increased NaOH concentration increased the rate of silver deposition slightly.

3. Dilution: 37 parts water to 1 of concentrate A, B, C.

| | |
|---|---|
| Temperature: | 125° F |
| Reaction time: | 180 sec. |
| Meter setting: | No. 1 at 9, No. 2 at 11 |
| Silver deposit: | 78 mgs/sq ft No. 1<br>80 mgs/sq ft No. 2 |

It was observed that the silver deposit increased somewhat with the increase in concentration of the reactants.

EXAMPLE XIV

Investigation was made of other polyhydroxy alditols of varying carbon chain lengths (erythritol and xylitol).

a. Concentration of solutions:

$AgNO_3$: $4 \times 10^{-2}$ moles/l

NaOH: $15 \times 10^{-2}$ moles/l + 0.3 ml $NH_4OH$ (28%)

Reducer: $4 \times 10^{-2}$ moles/l 1-thio glycerol: 0.004% by weight

Reaction time: 120 sec.

Reaction temperature: 20° C

| Sample | Reducer | | Gms $Ag^0$ |
|---|---|---|---|
| 63 | Erythritol | .0024. | The reaction was somewhat slower than with sorbitol but a good $Ag^0$ film was produced. |
| 64 | Xylitol | .0033 gms. | The reaction was much faster than with erythritol and produced a good, clean film, but xylitol was found to be not as efficient as d-glucitol per mol in these runs. |

Conclusions:

Both erythritol and xylitol do react with silver diammine in an alkaline environment to produce a silver mirror. Their rates of deposition are clearly less than d-glucitol (rate of reaction probably can be increased with an increase in concentration) but they produce excellent film quality.

EXAMPLE XV

Tests were run for comparison of conventional reducers with d-glucitol at varying reducer concentrations. These tests included a study of rates of silver deposition using the following materials as reducers: fructose, sodium glucoheptonate and mannitol.

The following concentrations were used:

| | |
|---|---|
| Silver diammine ions | $5 \times 10^{-2}$ moles/liter |
| Sodium hydroxide | $15 \times 10^{-2}$ moles/liter |
| Reaction time | 120 sec. |
| Temperature | 25° C |

| Test No. | Reducer | Reducer Concentration | Film mgms $Ag^0$ |
|---|---|---|---|
| 65 | Fructose | 0.25 M | 3.85 |
| 66 | Fructose | 0.50 M | 3.40 |
| 67 | Fructose | 0.75 M | 2.50 |
| 68 | Fructose | 1.00 M | 1.90 |
| 69 | Sodium glucoheptonate | 0.25 M | 3.90 |
| 70 | Sodium glucoheptonate | 0.50 M | 4.90 |
| 71 | Sodium glucoheptonate | 0.75 M | 4.90 |
| 72 | Sodium glucoheptonate | 1.00 M | 4.90 |
| 73 | Sodium glucoheptonate | 1.25 M | 4.90 |
| 74 | Sodium glucoheptonate | 1.50 M | 4.95 |
| 75 | Mannitol | 0.25 M | 4.10 |
| 76 | Mannitol | 0.50 M | 5.06 |
| 77 | Mannitol | 0.75 M | 5.06 |
| 78 | Mannitol | 1.00 M | 5.10 |
| 79 | Mannitol | 1.25 M | 5.10 |

-continued

| | | | |
|---|---|---|---|
| 80 | Mannitol | 1.50 M | 5.15 |

EXAMPLE XVI

Another run was conducted in a continuously running conveyor line for the production of mirrors utilizing a three part sludgeless silvering solution whose concentrations were as follows:

1. Silver Diammine: 33 av. ozs/gal. + 60 fl. oz. $NH_4OH$/gal.
2. Sodium Hydroxide: 1.5 lbs./gal. — 10 fl. ozs. $NH_4OH$/gal.
3. Sorbitol: 2.5 lbs./gal. (70% solution), 19 ml. formaldehyde (40% sln.), 0.1 ml. thiovanol.

Procedure:

1. The solutions were pumped from containers that held the concentrated solutions and the flow rate of the solutions was metered.
2. Solutions were heated to 120°F. and flowed at a rate of 24 ml. of concentrate A, B, C each per min.
3. A conveyor was used which was 48 inches wide and traveled at a linear speed of 85 inches/min. which corresponds to 28 sp. ft/min. of glass.
4. Silvering Section: reaction time of 40 sec. before the silvering solutions were rinsed with water. There were four sets of spray guns (first set 0.039 inch) orifice and the 2nd, 3rd, and 4th set of guns — 0.050 inch orifice).
5. Silvering was accomplished by an airless spray system. The console contained a flow meter to regulate the quantity of silvering solutions applied to the glass.

EXAMPLE 1

Flow rate: 24 ml. of concentrate A, B, and C per min.
Temperature: 120° F.
Reaction Time: 40 secs.
Silver deposit: 73 mgs/sp. ft.

It was observed that silver deposited evenly and cleanly. During this run, samples of mirrors were taken for a scotch tape adhesion test. Here, a piece of scotch tape was applied on top of each silver film and pressed firmly with the fingers. The tape was then quickly removed and observed for the removal of the silver film. In this test, no silver was removed. This is considered severe testing. The result attests to the tenacity of the adherence of this silver film to the glass.

SUMMARY

It has been discovered, accordingly, that great advantages can be enjoyed commercially with the use of alditols in the manner described in this specification.

Sorbitol is demonstrably a superior reducer as compared to gluconic acid and other such related materials, i.e., fructose, dextrose, etc. Sorbitol has shown conclusively the ability to reduce silver to its pure metallic state in a more efficient manner than gluconic acid and other reducers of conventional use. This means significant savings in the quantity of silver required to silver an object.

Further, it has been found that the silver deposited from solutions according to this invention adheres tenaciously to the substrate. Even using such a severe test as the "scotch tape" test, the silver adhered to the substrate and was not lifted off by the scotch tape.

Further, sorbitol has been shown to be stable in storage without loss of reducing ability in this electroless method of depositing silver. Further, it can be stabilized for a prolonged time with the aid of formaldehyde, potassium sorbate or other materials.

Sorbitol has the ability to withstand variations of temperatures of 10° C and more, without any substantial loss of efficiency. At water temperatures lower than 20° C, the efficiency of this reducer can be increased by heating the water. Sorbitol is stable upon heating. Heating to 50° C is possible without adverse effects such as disintegration or decomposition.

Indeed, sorbitol can be used at quite high temperatures (up to 130° F, for example) without decomposition or loss of its reducing capabilities. This increases the rate of silver deposition. Even at increased temperatures, sludging is readily controlled.

It is important to observe that although the highly preferred moderator compound is 1-thio glycerol, as described heretofore in the specification and examples, various other compounds may be used within the formula $CH_2OH(CHOH)_mCH_2SH$, where $m$ is an integer from 0 to 1.

In view of the fact that these thio compounds or mercaptans are quite compatible with each other, they may be used individually or as admixtures with each other. Regardless of the thio compound that is utilized in accordance with this invention, it should be present in the reducer solution in a proportion of 0.004 to 0.020% by weight of thio compound, based upon the weight of the water, and the percentage of polyhydric alcohol of the formula $CH_2OH(CHOH)_nCH_2OH$, where $n$ is an integer from 1 to 6, should be present in the same solution in the quantity of 5 to 35% by weight of said polyhydric alcohol, based upon the weight of the water. The thio compound and the polyhydric alcohol are quite compatible with each other and may be stored for an indefinite period in a common solution.

With respect to the silver solution that has been described herein as being desirably silver nitrate mixed with ammonia to form a soluble silver ammine compound, it will be appreciated that a wide variety of other silver solutions may be used as well, including well known silver compounds or salts, including complexes, coordination compounds and the like. However, it is highly preferred as has heretofore been stated to provide a silver complex with ammonia. However, this invention is not intended to be limited to any particular silver solution inasmuch as the novel moderating reducer compositions in accordance with this invention are highly effective with various types of electroless silver deposition solutions. In this connection it should be pointed out that although this invention has been preferably carried out with three solutions A, B and C as heretofore described, the novel reducer-modifier solution in accordance with this invention may be applied with great success to a single silver solution from which the silver is to be deposited.

The relative proportions of reactants in the silvering solutions may vary over a wide range. As has been disclosed in the examples, the ratio of the reducer-modifier solution to the silver compound may also vary over a wide range, preferably within the molar ratio range of about 1 to 1. Below this range the rate of deposition of silver upon the substrate suffers, and above this range the rate of reduction reaction does not materially increase.

Further, the ratio of silver salt to the other reactants may vary widely. Preferably the ratio of alkali metal hydroxide to silver salt is about 3:1 on a molar basis.

Various other parameters and factors in connection with the reaction, including concentrations, temperatures, ratios, methods of application, spraying, pouring, etc. are considered to be well within the capabilities of those skilled in the art. However, it is highly desirable in the actual performance of the process that the various reactant solutions are brought together just before contact with the substrate to which the silver is to be applied. This, of course, is attained in a manner that is familiar to persons skilled in the art.

Although this invention has been described with reference to certain particular compounds, processing conditions and other parameters, it will be appreciated that many variations may be made without departing from the spirit and scope of the invention as defined in the appended claims.

The following is claimed:

1. In a method of applying a coating of metallic silver to the surface of a substrate, wherein a silver solution containing reducible dissolved silver in the presence of an alkali metal hydroxide and ammonia is applied to the surface of said substrate, the improvement which comprises concurrently applying to the surface of said substrate and mixing in situ with said silver solution a separate aqueous solution of a moderating reducer comprising about 5 to 35%, by weight of the water, of a polyhydric alcohol of the formula $CH_2OH(CHOH)_nCH_2OH$ where $n$ is an integer from 1 to 6.

2. The method defined in claim 1, wherein said alcohol is selected from the group consisting of erythritol, threitol, arabinitol, ribitol, xylitol, allitol, galactitol, glucitol, sorbitol, iditol, mannitol, altritol, volemitol, glycero-altro hepitol, erythro-galacto octitol and dextro and laevo isomers thereof.

3. The method defined in claim 1, wherein said polyhydric alcohol is sorbitol.

4. The method defined in claim 1, wherein a moderator is concurrently applied to said substrate surface, said moderator comprising a thio compound of the formula $CH_2OH—(CHOH)_m—CH_2SH$ where $m$ is an integer from 0 to 1.

5. The method defined in claim 4, wherein said thio compound is 1-thio glycerol.

6. The method defined in claim 5, wherein said polyhydric alcohol is sorbitol.

7. The method defined in claim 1, wherein said substrate is glass.

8. The method defined in claim 1, wherein said dissolved silver, said hydroxide and said ammonia are mixed together before being applied as a mixture to said substrate, and wherein said polyhydric alcohol is separately applied at substantially the same location upon said substrate as the location to which said mixture is applied.

9. The method defined in claim 1, wherein said dissolved silver and said ammonia are mixed to form a solution (A) separately applied to said substrate, wherein a solution (B) of ammonia and said hydroxide is separately applied to said substrate, and wherein said reducer solution (C) comprising polyhydric alcohol is also separately applied to said substrate, all solutions (A), (B), and (C) being substantially concurrently applied at substantially the same location on the surface of said substrate.

10. The method defined in claim 1, wherein said reducer solution also contains about 5 to 15 ml of formaldehyde per pound of said polyhydric alcohol.

11. The method defined in claim 1, wherein said substrate is plastic.

12. The method defined in claim 1, wherein said substrate is ceramic.

13. In a method of modifying the silver reduction reaction in the electroless deposition of metallic silver as a film upon a substrate, wherein said silver is present in aqueous solution as a silver diammine and is applied continuously to a moving substrate, the step which comprises concurrently applying to the surface of said moving substrate and mixing with said aqueous silver diamine solution an aqueous solution of a polyhydric alcohol of the formula $CH_2OH(CHOH)_nCH_2OH$ wherein $n$ is an integer from 1 to 6.

14. The method defined in claim 13, wherein said alcohol is defined in claim 2.

15. The method defined in claim 13, wherein said alcohol is sorbitol.

* * * * *